United States Patent [19]

Yamada et al.

[11] 4,177,631

[45] Dec. 11, 1979

[54] SMALL-SIZED QUARTZ CRYSTAL WRISTWATCH

[75] Inventors: Haruyoshi Yamada; Kenichi Ushikoshi, both of Suwa, Japan

[73] Assignee: Kabushiki Kaisha Suwa Seikosha, Tokyo, Japan

[21] Appl. No.: 790,723

[22] Filed: Apr. 25, 1977

[30] Foreign Application Priority Data

Apr. 26, 1976 [JP] Japan ..... 51-47031

[51] Int. Cl.[2] ..... G04B 13/02; G04B 19/02; G04C 3/00

[52] U.S. Cl. ..... 58/23 BA; 58/23 AC; 58/23 D; 58/23 V; 58/125 R

[58] Field of Search ..... 58/7, 23 R, 23 AC, 23 BA, 58/23 D, 52 R, 53, 56, 85.5, 88 R, 125 R, 23 V

[56] References Cited

U.S. PATENT DOCUMENTS

| | | | |
|---|---|---|---|
| 3,737,746 | 6/1973 | Cielaszyk et al. | 58/23 AC X |
| 3,901,018 | 8/1975 | Erard | 58/88 R X |
| 3,902,312 | 9/1975 | Yamazaki | 58/23 D |
| 3,992,874 | 11/1976 | Collins | 58/23 BA X |
| 4,087,957 | 5/1978 | Miyasaka et al. | 58/23 R |

*Primary Examiner*—Stanley J. Witkowski

*Attorney, Agent, or Firm*—Blum, Moscovitz, Friedman & Kaplan

[57] ABSTRACT

A small-sized electronic wristwatch assembly, wherein a support plate is constructed and arranged to position the operative elements of the wristwatch to reduce the size thereof is provided. The electrical components of the wristwatch include a battery, a quartz crystal oscillator coupled to the battery for producing a high frequency time standard signal, a divider circuit coupled to the oscillator for dividing the high frequency time standard signal and producing a low frequency timekeeping signal, and an electro-mechanical transducer for receiving the low frequency timekeeping signal and in response thereto being continuously incrementally rotated. The mechanical components of the wristwatch include a center wheel and a gear train disposed intermediate the electro-mechanical transducer and the center wheel for transmitting to the center wheel a predetermined amount of rotation in response to each incremental rotation of the electro-mechanical transducer. Each of the operative components are disposed on a support plate, particularly configured to miniaturize the timepiece without affecting the operation and reliability thereof.

20 Claims, 6 Drawing Figures

SMALL-SIZED QUARTZ CRYSTAL WRISTWATCH

BACKGROUND OF THE INVENTION

This invention is directed to a small-sized quartz crystal electronic wristwatch, and in particular to providing each of the operative components of an electronic wristwatch on a support plate particularly configured to affect miniaturization of the wristwatch.

In recent years, because of the accuracy that was not heretofore obtainable in mechanical watches, electronic wristwatches, and in particular electronic wristwatches having a quartz crystal vibrator as a time standard, have become increasingly more popular. One disadvantage that has been noted however, with respect to such electronic wristwatches, is their relative bulkiness, when compared with mechanical wristwatches.

This disadvantage is particularly noted in women's fashion, which places a premium on small-size movements in order to permit the wristwatch to be styled to meet fashion requirements. Accordingly, a highly miniaturized and thinner electronic wristwatch movement that is sufficiently miniaturized to be utilized in watches designed particularly for women is desired.

SUMMARY OF THE INVENTION

Generally speaking, in accordance with the instant invention, a miniaturized quartz crystal vibrator wristwatch is provided. The wristwatch includes a support plate having a battery disposed thereon. A quartz crystal oscillator circuit is disposed on the support plate and is coupled to the battery for producing a high frequency time standard signal. Divider circuitry is disposed on the support plate and coupled to the oscillator circuit for dividing high frequency time standard signal produced by the oscillator circuitry and for producing a low frequency timekeeping signal. An electro-mechanical transducer is disposed on the support plate to receive the low frequency timekeeping signal and in response thereto be continuously incrementally rotated. A center wheel is rotatably disposed on the support plate and a gear train is disposed intermediate the electro-mechanical transducer and the center wheel for transmitting to the center wheel a predetermined amount of rotation in response to each incremental rotation of said electro-mechanical transducer. The support plate is constructed and arranged to position the battery so that the periphery thereof is disposed proximate to the center wheel, so that the battery is disposed in overlapping relationship with the center wheel, in plan view, and is further constructed and arranged to position the gear train out of overlapping relationship with the battery in plan view.

Accordingly, it is an object of this invention to provide a quartz crystal vibrator electronic wristwatch construction that is substantially reduced in size.

A further object of this invention is to provide an improved support plate for supporting each of the operative components of a quartz crystal electronic wristwatch and thereby define a wristwatch movement that is reduced in size.

Still a further object of the instant invention is to provide a quartz electronic wristwatch construction wherein the operative components of the wristwatch and the support plate are configured to effect a substantial miniaturization of the electronic wristwatch movement.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in conjunction with the accompanying drawings, in which.

DETAILED DESCRIPTION OF THE PREFERRED EMBODIMENTS

As is detailed below, the instant invention is directed to providing an electronic wristwatch construction that is smaller in size and thinner than that heretofore obtainable by optimizing the space provided in the case of an electronic wristwatch. To this end, each of the respective operative components comprising the electronic timepiece movement have been configured to obtain a smaller sized electronic wristwatch, taking into account the battery, step motor coil and quartz crystal vibrator assembly, which elements are the largest operative elements of the electronic wristwatch and, hence, are determinative in effecting a reduction in the size thereof. As is demonstrated below, the electro-mechanical transducer, gear train, circuitry, tuner capacitors, etc., have been constructed and arranged with respect to the battery, step motor coil and quartz crystal vibrator assembly to provide a highly reliable miniaturized electronic wristwatch.

Figure 1:
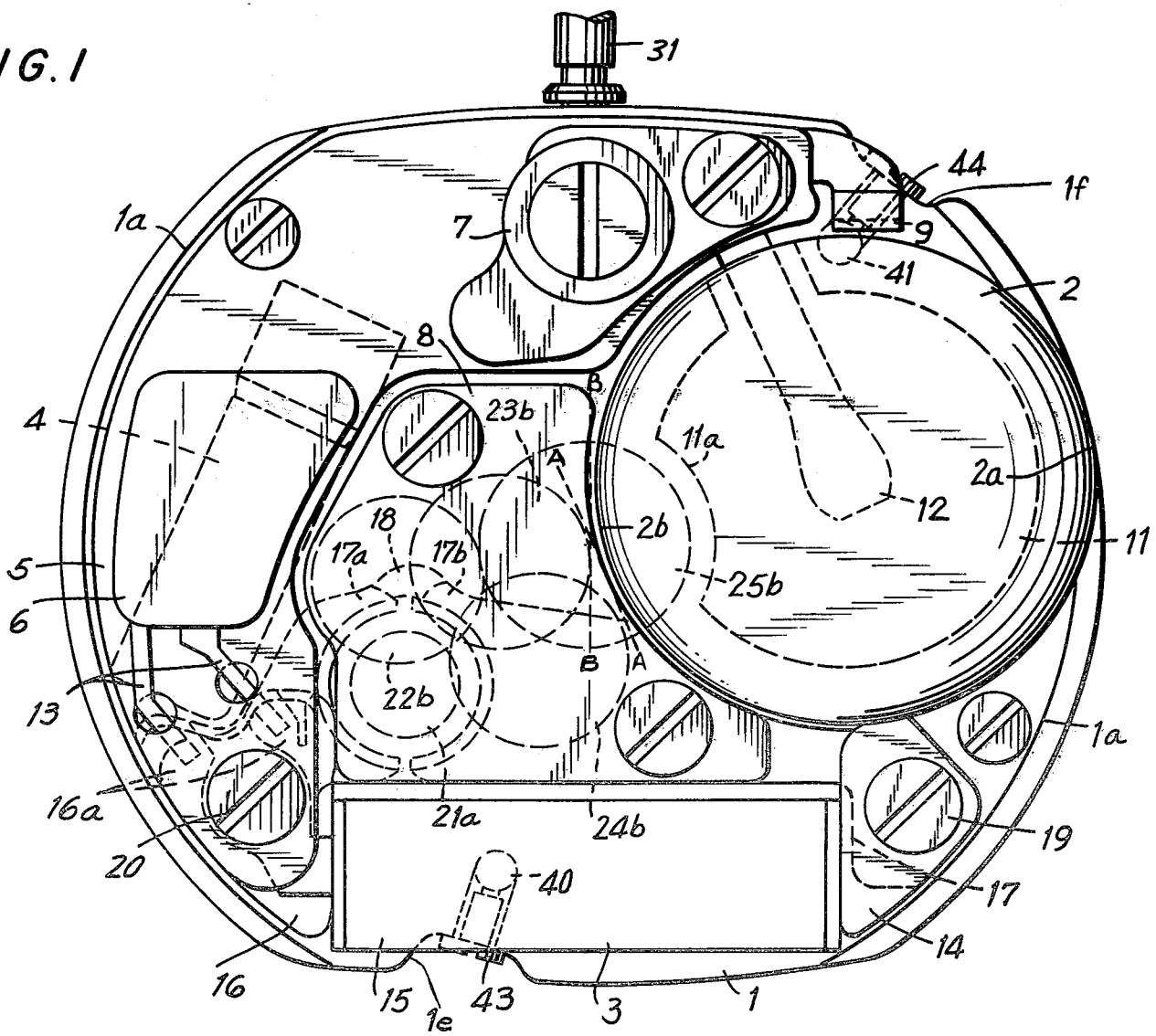
FIG. 1 is a plan view of a quartz crystal electronic wristwatch constructed in accordance with a preferred embodiment of the instant invention.
Figure 2A:
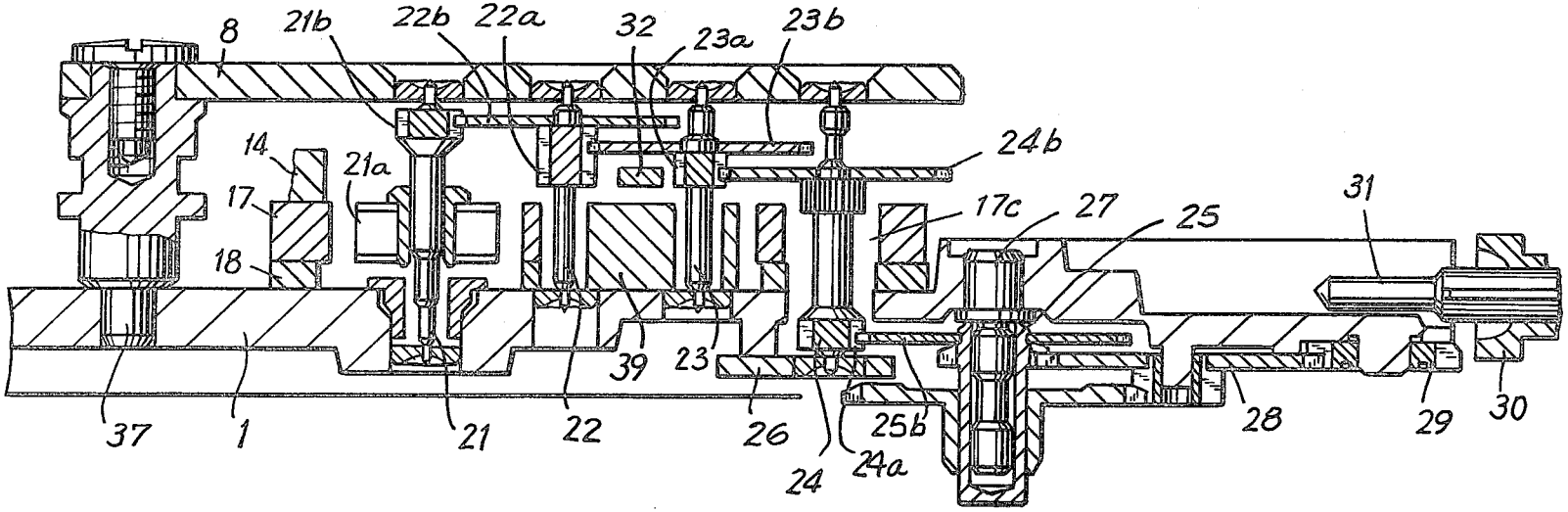
FIG. 2*a* is an elevational sectional view taken through the electronic wristwatch depicted in FIG. 1.
Figure 2B:
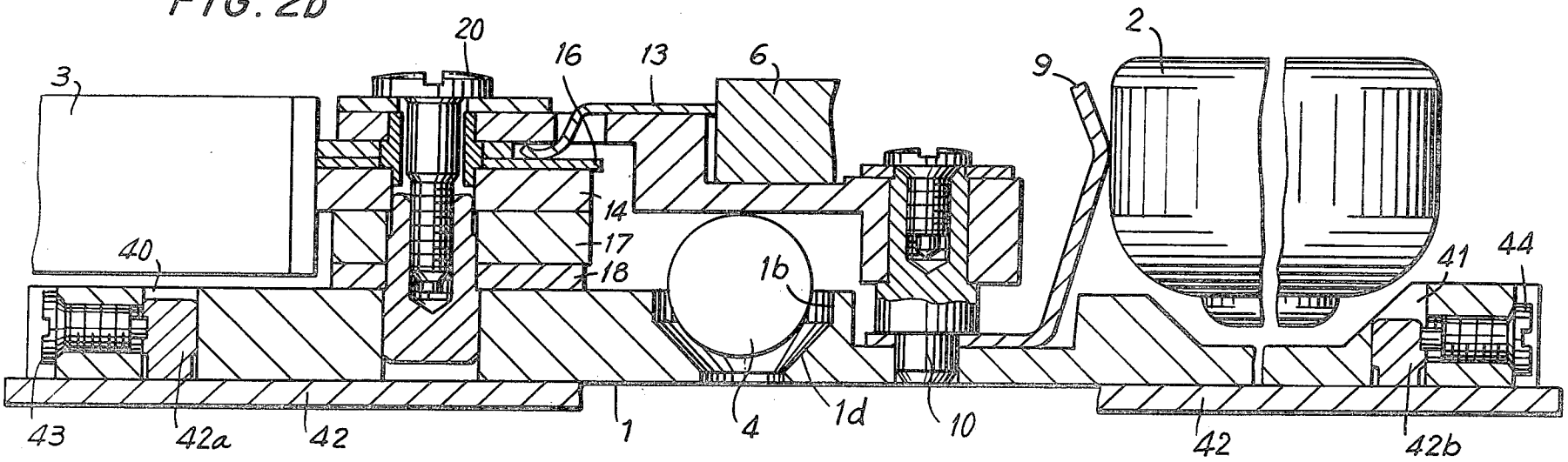
FIG. 2*b* is a further sectional view taken through the electronic wristwatch depicted in FIG. 1.

Reference is initially made to FIGS. 1, 2*a* and 2*b*, wherein an electronic wristwatch, constructed in accordance with the instant invention, is depicted. A support plate 1 is adapted to support a DC battery 2, which battery is positioned so that the periphery thereof extends to the position 2*a* at the periphery of the support plate, and additionally, extends to a position 2*b* that is proximate to the center of the support plate 1. It is noted that the smallest DC battery comercially available at this time is 7.9 mm in diameter. Moreover, if the quartz crystal wristwatch is provided with three hands (hours, minutes, seconds), the pinion of the second hand shaft, or alternatively, the gear and battery cannot be disposed in overlapping relationship when seen in plan view. In such event, the minimum permissible diameter of movement is the sum total of the diameter of the battery, the diameter of the gear or pinion, and the remaining members and spaces therebetween. Accordingly, in small-sized electronic wristwatches, constructed in accordance with the prior art, the minimum diameter has been about 18 mm. The instant invention is directed to an electronic timepiece having only two hands (hours, minutes), and a suitable gear train for driving same, in order to effect suitable miniaturization of the electronic timepiece.

Returning to FIG. 1, the DC battery 2 is disposed in overlapping relationship, as seen in plan view, with center wheel 25*b* and pinion 25 (FIG. 2*a*) supporting same. Such overlap permits the electronic movement of a wristwatch, constructed in accordance with the instant invention, to have a maximum diameter of 16 mm and a minimum diameter of 13.6 mm. Also, as illustrated in FIG. 1, the support plate is constructed and arranged to dispose the gear train on the opposite side of an imaginary (dashed) line A—A, which line diametrically intersects the center wheel 25*b*. A further imaginary line B—B is substantially in alignment with the lengthwise extent of stem 31.

To obtain this miniaturization, a coil 3 and the quartz crystal vibrator assembly 4 are positioned on the support plate 1 in non-overlapping relationship, as seen in plan view, with respect to each other and with respect to the battery 2. It is noted that the quartz crystal vibrator is preferably formed by photo-eteching since such a manufacturing technique contributes to mass production of an electronic wristwatch constructed in accordance with the instant invention. Moreover, the quartz crystal vibrator is disposed in a cylindrical case in order to reduce the space occupied by the quartz crystal vibrator assembly in the electronic wristwatch, and thereby further reduce the size of the movement. The quartz crystal vibrator assembly 4 is disposed in a circuit block 5, which block includes, in addition to the quartz crystal vibrator assembly, a C-MOS IC 6 for producing the current consumption of the electronic timepiece circuitry and a trimmer capacitor 7 for tuning the high frequency time standard signal produced by the quartz crystal vibrator assembly. It is noted that the C-MOS IC 6 is disposed in overlapping relationship with the vibrator assembly 4, as seen in plan view, in order to reduce the space occupied thereby.

The circuit block 5 provides the entire circuitry for an electronic timepiece including the remaining circuitry for defining the oscillator circuitry to which is coupled the quartz crystal vibrator assembly for the purpose of producing a high frequency time standard signal, as well as the divider circuitry for dividing down the high frequency time standard signal and producing a low frequency timekeeping signal to be applied to the coil of the electro-mechanical step motor to effect a stepping of the rotor through a predetermined incremental rotation. As is detailed below, assembly, adjustment of the time displayed by the electronic timepiece, and post-sales service are facilitated by the manner in which the support plate positions the respective operative elements and, additionally, the gear train including the third wheel bridge 8, illustrated in FIG. 2*a*.

Figure 5:
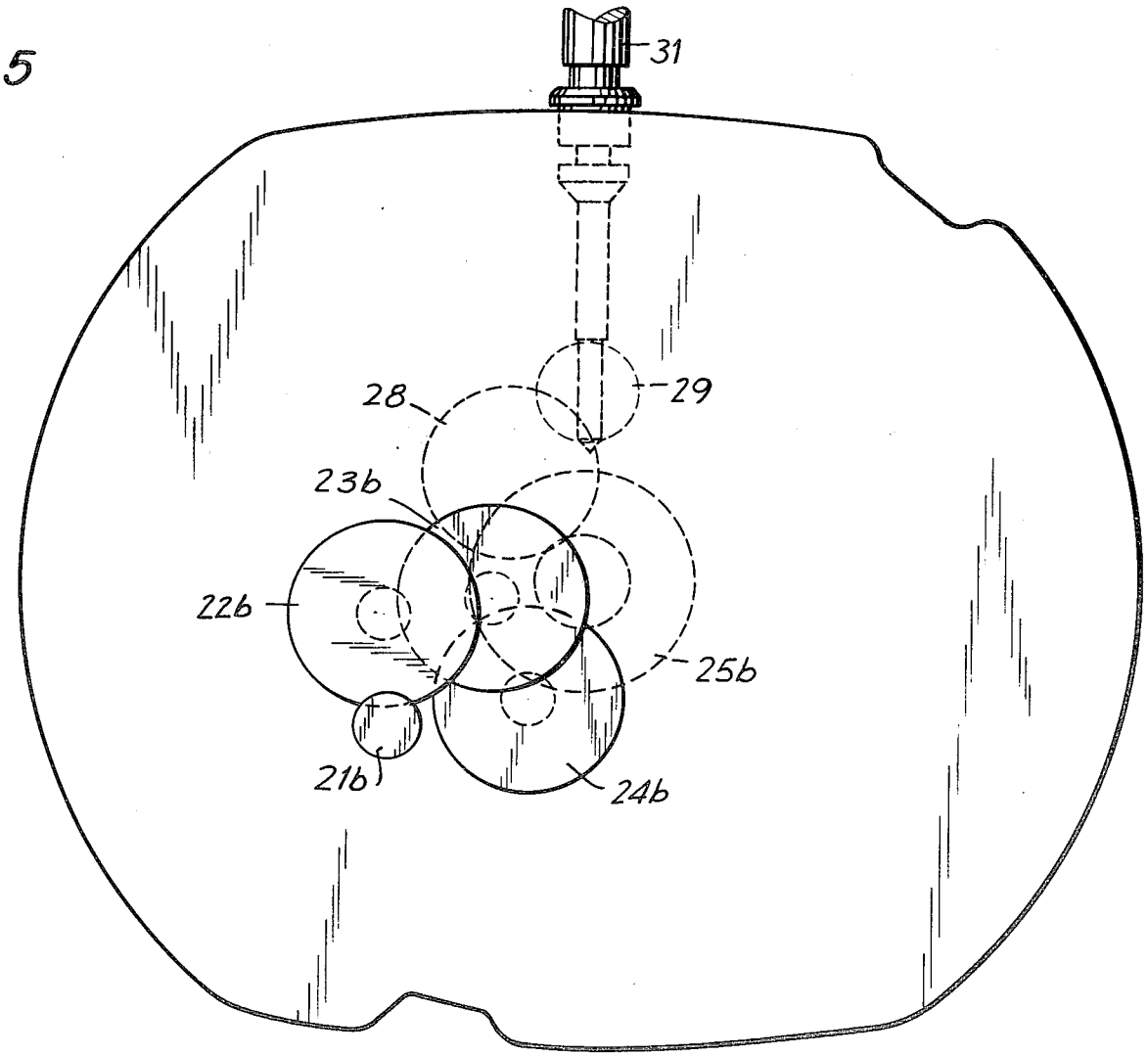
FIG. 5 is a plan view of the electronic timepiece depicted in FIG. 1 illustrating the relationship between the wheels of the front gear train and back gear train.

As is illustrated in FIGS. 1 and 5, unlike conventional electronic wristwatches, the support plate 1 is not circular. Instead, a side-cut form is utilized so that the cutaway portions from the usual circular shape are equally shaped arcs that intersect the circular portion of the plate remaining. By referencing the stem 31 at the three 0'clock position, it becomes apparent that the dimension of the timepiece in the three 0'clock–nine o'clock direction is considerably reduced with respect to the dimension of the electronic timepiece in the twelve O'clock–six o'clock direction. Thus, each of the edges of the support plate, defining the periphery, are arcuate in shape, with the opposed arcuate edges having equal radii. Although it would appear that a conventional circular plate would provide more space for the operative components of the electronic timepiece, it has been found that the additional area, provided by a circular support plate, is utilized as a contact surface such as 1*a* for mounting the casing, and accordingly, the non-circular support plate of the instant invention eliminates this unnecessary surplus space. Moreover, the non-circular side-cut support plate 1 is substantially square in appearance which permits the case of the watch to take on a substantially square configuration, which configuration is particularly popular in women's fashion. Also, conventional oval-shaped support plates are clearly larger than the side-cut support plate 1 of the instant invention.

Referring now to FIGS. 2*a* and 2*b*, the side-cut support plate 1 is further formed to facilitate the manner in which the operative elements of the timepiece are positioned thereby, and additionally, to facilitate obtaining access to the respective operative elements. The quartz crystal vibrator assembly 4 is secured to the rear surface of the circuit block 5 and is positioned under the surface of the plate supporting the circuit configuration. In order to securely position the quartz crystal vibrator assembly 4 on the rear side of the circuit block 5, and additionally positionally secure same with respect to the support plate 1, the support plate 1 is provided with a recess 1*b* defined by inclined side walls 1*d*, which walls define the recess in which the quartz crystal vibrator assembly is secured. Additionally, a through hole is provided on the front surface of the support plate 1 in order to facilitate the removal of the quartz crystal vibrator from the recess 1*b* formed in the support plate 1 for receiving the quartz crystal vibrator assembly 4. It is noted that the quartz crystal vibrator assembly is disposed near the periphery of the support plate 1 in order to assure that same will be disposed out of overlapping relationship, when seen in plan view, from the battery 2 and coil 3. The forming of a recess, having inclined walls in the support plate, instead of reducing the thickness of the support plate throughout prevents the support plate from being damaged during assembly and reduces the fragility of same that would likely be caused if the support plate were reduced in thickness throughout the entire periphery thereof. Similarly, as is illustrated in FIG. 2*b*, inclined surfaces are provided in the support plate 1 in order to receive the battery 2 so that the strength of the support plate is also not diminished by reducing same throughout to a thickness sufficient to accommodate the battery 2.

The battery 2 is disposed in a recess formed in the support plate and is coupled to the circuitry of the electronic timepiece through a positive lead plate 9 and a negative lead plate 12. Positive lead plate 9 is secured to the support plate 1 by fixing pins 10 and 34 (FIG. 4) to thereby dispose the positive lead plate in electrical connection with the circuit elements through the fixing pin 10. The negative battery lead plate 12 is fixedly secured to the circuit block in order to couple the negative terminal of the battery thereto. An insulating plate 11 for insulating the lead plate 12 and lower terminal of the battery from the support plate is disposed in the battery receiving recess in the support plate 1 and is provided with a notch 11*a* that is configured to insure that same is out of vertical contact with the center wheel and cannon-pinion 25 supporting the center wheel. Resilient lead 13 defines an output terminal of the C-MOS-IC circuit 6 and is resiliently disposed against the electrode portion 16 of coil core 14 for generating a magnetic flux in the coil 3. Specifically, as is illustrated in FIG. 1, the resilient output lead 13 is biased against the electrode portion 16*a* of the coil lead plate 16 to which both ends of the coil wire 15 are soldered. By this configuration, the output signal of the circuitry is transmitted to the coil 3. Coil lead plate 16 is mounted to the surface of the coil core 14 with a portion thereof protruding beyond the coil core 14. Although the electrodes can be formed in the shape of the coil lead plate in conventional electronic wristwatches, as the movement of the electronic wristwatch is miniaturized, the coil core 14 is reduced in shape and area, thereby reducing the area of the coil lead plate 16, and thereby requiring a like reduction in the area of the electrode 16*a*. The external shape of the electrode 16*a* of coil lead plate 16 is therefore configured to eliminate this problem. However, the electrode can be bent to the side of the coil lead plate 16 as a result of a pressure applied by resilient output lead 13 and thereby cause output lead 13 to contact coil core 14 and define a short circuit therebetween. Accordingly, the coil lead plate 16 is shaped to protrude beyond that of the coil 14 in order to prevent the electrode from bending and otherwise causing a short circuit between the output lead and the coil core 14.

The coil core 14 includes a portion disposed proximate to the periphery of the battery 2 in order to aid in guiding the battery into position, and thereafter for positioning the battery 2 within the support plate 1. Thus, the battery 2 is maintained in position by the portion of the coil core 14 in abutting engagement therewith and the pressure of the lead plate 9 disposed thereagainst.

Both ends of the coil core 14 of the coil 3, and the stator of the electro-mechanical transducer are formed in overlapping position, when seen in plan view. The coil 3 is secured to the support plate 1 by fixing screws 19 and 20. The stator plate 17 is positioned on the surface of the support plate 1 in order to define a fixed gap between the portions 17*a* and 17*b* of the stator. An end-piece 18, for the stator, is secured to the support plate by a spot weld.

The stator 17 of the electro-mechanical step motor surrounds a rotor 21*a*, which rotor is formed of a diametrically oppositely poled magnet. Accordingly, as is explained in detail below, the stator effects an incremental rotation or stepping of the rotor 21*a* in a conventional manner so that the step motor, in effect, converts the low frequency timekeeping signals produced by the divider circuitry and applied to the core 3 into a rotational movement of the rotor 212.

The incremental rotation of the rotor 212 is reduced by a gear train to a specific rotational increment corresponding to actual time by means of a gear train, which gear train is illustrated in FIGS. 1, 2*a* and 5. The rotor 21*a* of the step motor is supported by a pinion 21 and, in response to an output signal applied every 2.5 seconds to the coil core, is rotatably stepped. The pinion 21 is rotatably disposed in bearings supported in the support plate 1 and third wheel bridge 8. The pinion 21 also supports a gear 21*b*, which gear is coupled to a fifth gear wheel 22*b* supported on a fifth pinion 22. Fifth pinion 22 is rotatably disposed in bearings formed in the support plate 1 and third wheel bridge 8, and is rotated in response to each stepping of the rotor 21*a*. In addition to gear wheel 22*b*, a gear 22*a* is supported on pinion 22, which gear is disposed in meshing engagement with fourth gear wheel 23*b* in order to transmit a rotary motion thereto. Fourth gear wheel 23*b* is supported by a pinion 23 and includes a fourth gear 23*a* constructed and arranged in the same manner as the fifth gear wheel, gear and pinion arrangement detailed above and imparts rotary motion to a third gear wheel 24*b*, pinion 24 and gear 24*a*, in the same manner discussed above. Accordingly, the fifth pinion, fourth pinion and third pinion are each supported by the support plate 1 and third wheel bridge 8, in order to impart to a center wheel 25*b* a predetermined rotary motion to effect the driving of the minute hand thereby. Center wheel 25*b* is rotatably disposed in an outer bearing, formed in the support plate, in meshing engagement with a minute wheel 28 in a conventional manner. Also, center wheel 25*b* is disposed on a cannon pinion 25, which pinion is disposed in an axle bearing 27 in the back surface of the support plate 1 to permit same to be freely rotated.

It is noted that the stator poles 17 are provided with a plurality of holes, such as hole 17*c*, for permitting the third gear wheel 24*b* and pinion 24 supporting same to be positioned within the hole in the stator thereby facilitating positioning of the respective pinion arrangement when the timepiece is assembled. Although the pinion 24 and third gear wheel supported thereby can be positioned in the same position as the minute wheel 28, the position of the minute wheel must take into account the position of the clutch wheel 30 and setting wheel 29, which wheels transmit the rotary motion of the stem 31 to the minute wheel. It is noted that if the minute wheel 28 is not positioned symetrically with respect to the longitudinal axis of the stem 31, the minute wheel 28 and battery 2 will be disposed in overlapping relationship when viewed in plan, thereby rendering it very difficult to remove the minute wheel 28.

Accordingly, in an exemplary embodiment, the gear train is positioned so that same is surrounded by the coil 3 and battery 2, to thereby provide an optimum distribution and positioning of the gear train. The gear wheels, and gears, of the back gear train, including fifth, fourth and third gear wheels, are therefore disposed in substantially overlapping relationship with respect to each other, as seen in plan view, and additionally, in substantially non-overlapping relationship with respect to the front gear train, to thereby provide a thinner and more compact electronic wristwatch movement.

Figure 4:
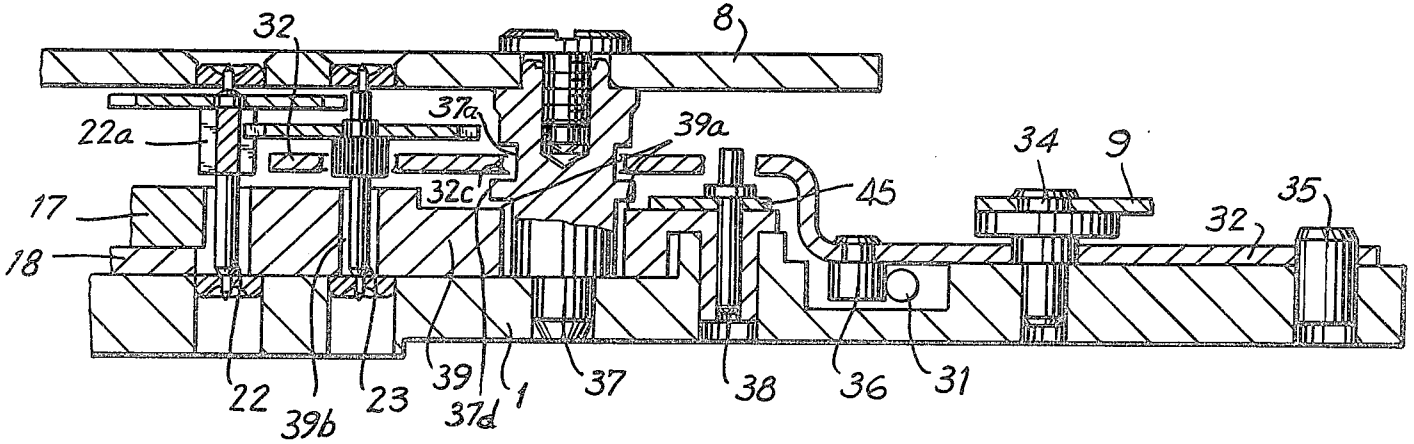
FIG. 4 is an elevational sectional view of a portion of the electronic wristwatch depicted in FIG. 1.
Figure 3:
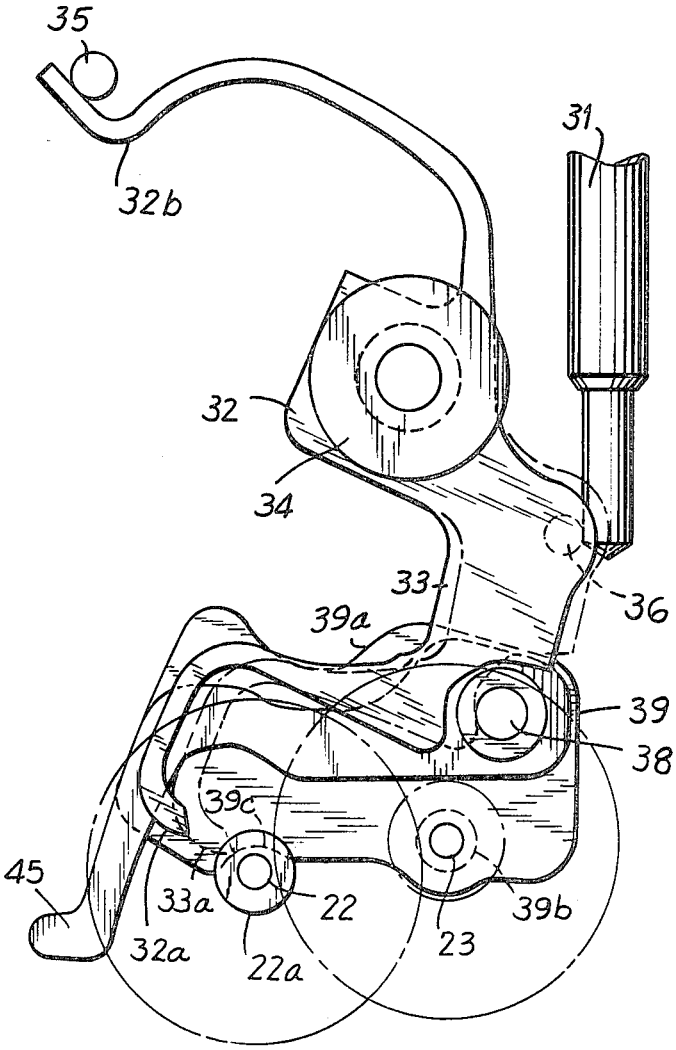
FIG. 3 is a plan view of the regulating mechanism of the electronic wristwatch depicted in FIG. 1.

Turning now to FIGS. 3 and 4, the regulating and reset lever mechanism of the miniaturized electronic timepiece, depicted in FIG. 1, is illustrated in detail. Regulating lever 32 is adapted to be displaced to a position 33, illustrated in phantom in FIG. 3. When the regulating lever 32 is displaced to position 33, an engaging portion 32*a* thereat is displaced to the position 33*a*, illustrated in phantom in FIG. 3, which position is in engagement with the fifth gear wheel 22*a*. The regulating lever is pivoted about a fixed pin 34, which pin is secured to the support plate 1. As is noted above, the fixed pin 34 is also utilized to fixably mount the positive lead plate 9 in position.

The tail portion 32*b* of the regulating lever 32 is resiliently biased in engagement with pin 35. A lever pin 36 is formed on regulating lever 32 and is positioned in abutting engagement with stem 31 to prevent the regulating lever 32 from being pivoted about pin 34 in response to the resilient biasing force applied by the pin 35 to the tail portion of the regulating lever. Additionally, the pin 34 is provided with a collar in the upper portion thereof, in which collar is engaged the regulating lever 32, to thereby insure that the regulating lever is maintained or fixed at a proper elevation with respect to the remaining components of the timepiece. Accordingly, in addition to providing a pivot for the regulating lever 32, the pin 34 fixes the elevation of the regulating lever with respect to the elevation of the remaining structural elements in the movement. Similarly, a portion 32*c* of the regulating lever 32 is positioned within a notch 37*a* formed in the third bride support 37 when the lever is disposed in a regulating position 33 in order to further insure that the regulating lever is disposed in proper elevational registration with respect to the elements in the electronic timepiece movement. It is necessary to maintain this elevational relationship between the engaging portion 32*a* of the regulating lever 32 and the gear wheel 22*a* of the gear train.

The regulating lever 32 is selectively displaced to position 33 by removing the stem 31 away from the regulating lever pin 36, to thereby pivot the engaging portion 32*a* of the regulating lever into engagement with gear wheel 22*a* and hence effect a regulation of the fifth wheel pinion 22. Simultaneously therewith, the divider circuit is reset to zero by the pivoting of the regulating lever into contact with reset pin 38, which pin is secured to the support plate 1. Additionally, an insulating frame 39 is provided for insulating the reset lead plate and for preventing same from being deformed when the timepiece is assembled. Moreover, it is possible for the insulating frame 39 to prevent other parts from being deformed during construction and also from preventing electrical contact between the close fitting elements, when such electrical contact should be avoided. Any looseness in the firt of the parts, or play, is prevented by providing an overlapping portion 39*a* of the insulated frame 39, which portion overlaps the projecting portion 37*d* of the third bridge support 37. Additionally, the insulating frame 39 is provided with suitable openings, such as opening 39*b*, for permitting the respective gear wheels and pinions to be positioned therein. For example, the manner in which the fourth gear wheel 23*b* and pinion 23 are oriented is by permitting the tenon to be fit into the opening 39*b* during assembly and permitting same to rest thereagainst until the third wheel bridge 8 is brought into position to pivotably secure the respective tenons.

Additionally, the instant invention provides for recesses 40 and 41 located in peripherally disposed notches 1*e* and 1*f*, respectively provided in support plate 1 to permit a dial to be readily secured to the support plate 1. As is illustrated in FIG. 2*b*, recesses 40 and 41 permit dial feet 42*a* and 42*b*, projecting from dial 42, to be disposed therein and secured by screws 43 and 44, which screws are disposed peripherally with respect to the dial 42. The openings for receiving the dial feet are disposed so that they respectively overlap the coil 3 and battery 2. Accordingly, the instant invention recognizes that the battery and coil although utilizing considerable space, as seen in plan view, do permit other elements to be elevationally disposed above and below these elements, such as under the curved under-portion of the battery. Similarly, the third wheel plate 8 is disposed in substantial overlap with the coil 3, as seen in plan view, thereby utilizing space in the movement that is otherwise wasted. Accordingly, by the configuration of the elements detailed above, and the configuration of the support plate for supporting these elements, a miniaturized quartz crystal electronic wristwatch movement is provided.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An electronic wristwatch comprising support means, a battery means disposed on said support means, quartz crystal oscillator means, said quartz crystal oscillator means including a quartz crystal vibrator, said quartz crystal vibrator being formed by photo-etching, and a cylindrical case, said quartz crystal vibrator being disposed in said cylindrical case, said quartz crystal oscillator means being disposed on said support means and coupled to said battery means for producing a high frequency time standard signal, divider means disposed on said support means and coupled to said oscillator means for dividing a high frequency time standard signal produced by said oscillator means and in response thereto producing a low frequency timekeeping signal, and electro-mechanical transducer means disposed on said support means for receiving said low frequency timekeeping signal and in response thereto being continuously incrementally rotated, a center wheel rotatably disposed on said supporting means, and a gear train disposed intermediate said electro-mechanical transducer means and said center wheel for transmitting to said center wheel a predetermined amount of rotation in response to each incremental rotation of said electro-mechanical transducer means, said support means including a support plate constructed and arranged to position said battery so that the periphery thereof is disposed proximate to said center wheel, so that said battery means is disposed in overlapping relationship with said center wheel in plan view, and is further constructed and arranged to position said gear train out of overlapping relationship with said battery means in plan view, said support plate being further adapted to position said gear train on the opposite side of an imaginary line from said battery means, said imaginary line intersecting said center wheel at a position substantially tangent to said battery means, and a stem disposed on said support means, the axial direction of said stem being disposed in substantial alignment with a further imaginary line intersecting said center wheel, said further imaginary line being disposed at a position substantially tangent to said battery means.

2. An electronic wristwatch as claimed in claim 1, wherein said electro-mechanical transducer means includes a coil, said coil, battery means, and support plate being constructed and arranged to dispose said battery means, coil and cylindrical quartz crystal vibrator assembly case in non-overlapping relationship in plan view.

3. An electronic wristwatch as claimed in claim 2, wherein said coil includes a magnetic core secured to said support plate, said magnetic core being disposed in abutting relationship with said battery means to thereby position said battery means on said support plate.

4. An electronic wristwatch as claimed in claim 2, and including a dial, said dial having dial feet, said support plate being formed with recesses for receiving said dial feet, said recesses being positioned in said support plate in overlapping relationship with said coil and said battery means, in plan view.

5. An electronic wristwatch as claimed in claim 4, including securing means and notches disposed in the support plate at positions proximate to said recesses for permitting said securing means to be disposed against said dial feet to thereby secure said dial feet therein, said notches providing access to said securing means.

6. An electronic wristwatch as claimed in claim 1, wherein said support means includes a bridge plate for supporting said gear means, and a bridge guide pin for positioning said gear support plate with respect to said support plate, said bridge guide pin being provided with a recess therein, said regulating lever being disposed in said recess in order to elevationally position said regulating lever with respect to said gear train means.

7. In an electronic wristwatch comprising support means, a battery means disposed on said support means, quartz crystal oscillator means coupled to said battery means and disposed on said support means for producing a high frequency time standard signal, and divider means disposed on said support means and coupled to said battery means and to said oscillator means for receiving said high frequency time standard signal produced by said oscillator means and in response thereto producing a low frequency timekeeping signal, step motor means disposed on said support means, said step motor means including a magnetic rotor means, a stator means surrounding said rotor means for effecting an incremental rotation of said rotor means, a magnetic coil, said magnetic coil including a magnetic core coupled to said stator means and a winding wrapped around said magnetic core, said winding being coupled to said divider means for inducing an alternating polarity magnetic field in said magnetic rotor and stator means in response to said timekeeping signal being applied thereto, a center wheel rotatably disposed on said support means, and gear means supported by said support means intermediate said step motor means and said center wheel for transmitting to said center wheel a predetermined amount of rotation in response to each incremental rotation of said rotor means, said support means including a support plate constructed and arranged to position said magnetic core and battery means at the periphery of said support plate so that said magnetic core is disposed in abutting engagement with said battery means in order to effect positioning thereof, said support plate including at least two dial feet receiving recesses, and a dial having at least two dial feet, said dial feet being adapted to be inserted into said dial feet receiving recesses formed in said support plate, and said feet recesses being positioned on said support plate in overlapping relationship with said battery means and said coil core, respectively, as seen in plan view.

8. An electronic wristwatch as claimed in claim 7, and including notches, said notches being peripherally disposed in said support plate for permitting retaining means to be disposed in abutting engagement with said dial feet when same are disposed in said dial feet receiving means, in order to effect an anchoring of said dial feet to said support plate.

9. An electronic wristwatch comprising support means, battery means, disposed on said support means, a quartz crystal oscillator means electrically coupled to said battery means and disposed on said support means for producing a high frequency time standard signal, and divider means disposed on said support means and coupled to said battery means and to said oscillator means for receiving said high frequency time standard signal and in response thereto producing a low frequency time standard signal, electro-mechanical transducer means disposed on support means for receiving said low frequency timekeeping signal and in response thereto being incrementally rotated, a center wheel rotatably disposed on said support means, a back gear train supported by said support means intermediate said electromechanical transducer means and said center wheel for tansmitting to said center wheel a predetermined amount of rotation in response to each incremental rotation of said electro-mechanical transducer means, said support means including a support plate and back gear train bridge plate for rotatably positioning said back gear train therebetween, and at least one bridge guide pin for fixedly positioning said bridge plate and support plate in spaced apart relationship, said bridge guide pin including a recess formed therein, and a regulating lever adapted to be selectively displaced into an engagement position with said back gear train, said regulating lever means being disposed in said recess in said bridge pin to fixably dispose said regulating lever is fixed elevational relationship with respect to said gear train.

10. An electronic wristwatch as claimed in claim 9, and including first and second resilient leads coupled to said battery means, and a pivot pin supported by said support means, said regulating lever being pivotably mounted to said pivot pin, said first resilient lead being fixably secured to said pivot pin to effect fixable positioning of said first resilient lead with respect to said battery means.

11. An electronic wristwatch as claimed in claim 10, and including a fixed reset pin supporting a reset lead plate coupled to said divider means for selectively applying a reset signal thereto in response to said regulating lever being displaced into abutting engagement with said reset pin, said support plate being constructed and arranged to position said reset pin to be abuttingly engaged by said regulating lever when said regulating lever is displaced to said engaging position, and an insulating frame disposed on said support plate between said reset lead plate and said support plate, said insulating frame being further adapted to surround and position said back gear train.

12. An electronic wristwatch comprising a support means, battery means disposed on said support means, quartz crystal oscillator means energized by said battery means and disposed on said support means for producing a high frequency time standard signal, and divider means energized by said battery means and disposed on said support means and coupled to said oscillator means for receiving said high frequency time standard signal and in response thereto producing a low frequency timekeeping signal, electro-mechanical transducer means disposed on said support means for receiving said low frequency timekeeping signal and in response thereto being incrementally rotated, a center wheel rotatably disposed on said support means, and a gear train supported by said support means intermediate said electro-mechanical transducer means and said center wheel for transmitting to said center wheel a predetermined amount of rotation in response to each incremental rotation of said electro-mechanical transducer means, said support means including a non-circular support plate having a periphery defined by opposed concentric circular arcuate sides, intersected by reduced dimensional arcuate sides, said respective opposed concentric circular arcuate sides having equal radii of greater dimensions than the radii of said reduced dimensional arcuate sides.

13. An electronic wristwatch as claimed in claim 12, wherein said quartz crystal oscillator means includes a quartz crystal vibrator assembly, circuitry for energizing said quartz crystal oscillator means, and an integrated circuit chip including said oscillator means and said divider means, said integrated circuit chip and said quartz crystal vibrator assembly being disposed in overlapping relationship, in plan view.

14. An electronic wristwatch as claimed in claim 13, and including a through-hole formed in said support plate in overlapping relationship with said quartz crystal vibrator assembly, in plan view, for facilitating the removal of said quartz crystal vibrator assembly from said support plate.

15. An electronic wristwatch as claimed in claim 13, and including a cylindrical case, said quartz crystal vibrator assembly being formed in said cylindrical case, and said support plate including a recess for receiving said cylindrical case, said recess being defined by opposed inclined walls terminating in a bottom wall, said bottom wall including a through-hole formed therein for facilitating the displacement of said cylindrical casing from said recess.

16. An electric wristwatch comprising support means, battery means disposed on said support means, quartz crystal oscillator means disposed on said support means and coupled to said battery means for producing a high frequency time standard signal, divider means disposed on said support means and coupled to said oscillator means for dividing a high frequency time standard signal produced by said oscillator means and in response thereto producing a low frequency timekeeping signal, and electro-mechanical transducer means disposed on said support means for receiving said low frequency timekeeping signal and in response thereto being continuously incrementally rotated, a center wheel rotatably disposed on said support means, and a gear train disposed intermediate said electro-mechanical transducer means and said center wheel for transmitting to said center wheel a predetermined amount of rotation in response to each incremental rotation of said electro-mechanical transducer means, said gear train including a plurality of gear means, each said gear means including a rotatable pinion, and a regulating lever coordinately displaceable between a rest position and an engaging position, said support means being constructed and arranged to pivotably support said regulating lever and permit same to be selectively displaced into said engaging position and thereby engage at least one of said rotatable pinions in said gear train and thereby prevent the rotation of said pinion.

17. An electronic wristwatch comprising support means, a battery means disposed on said support means, quartz crystal oscillator means disposed on said support means and coupled to said battery means for producing a high frequency time standard signal, divider means disposed on said support means and coupled to said oscillator means for dividing a high frequency time standard signal produced by said oscillator means and in response thereto producing a low frequency timekeeping signal, an electro-mechanical transducer means disposed on said support means for receiving said low frequency timekeeping signal and in response thereto being continuously incrementally rotated, a center wheel rotatably disposed on said support means, and gear means disposed intermediate said electro-mechanical transducer means and said center wheel, said gear means including a plurality of gears, a first gear being mechanically coupled to said electro-mechanical transducer means for being rotated thereby, and one further gear means disposed in meshing engagement with said center wheel at a predetermined position to effect a predetermined amount of rotation of said center wheel in response to said incremental rotation of said electro-mechanical transducer means, said further gear means being disposed in meshing engagement with said center wheel so that said further gear means is disposed proximate to the periphery of said battery means and out of overlapping relationship with said battery means in plan view, said support means including a support plate constructed and arranged to position said battery means so that the periphery thereof is disposed proximate to said center wheel, so that said battery means is disposed in overlapping relationship with said center wheel in plan view.

18. An electronic wristwatch as claimed in claim 17, wherein said electro-mechanical transducer means includes a rotor rotatably supported by said support means, said rotor being disposed in meshing engagement with said first gear, said support plate being constructed and arranged to position said further gear means in overlapping relationship with said first gear and said rotor, in plan view.

19. An electronic wristwatch as claimed in claim 18, wherein said support plate is constructed and arranged to position said battery means so that the periphery thereof is disposed proximate to said center wheel so that said battery means is disposed in overlapping relationship with said center wheel in plan view and is further constructed and arranged to position said further gear means out of overlapping relationship with said battery means in plan view.

20. An electronic wristwatch as claimed in claim 17, and including a minute wheel coupled in meshing engagement with said center wheel, said minute wheel being disposed out of overlapping relationship with said further gear means, in plan view.

* * * * *